United States Patent [19]

Nagy

[11] Patent Number: 4,707,700

[45] Date of Patent: Nov. 17, 1987

[54] VEHICLE ROOF MOUNTED SLOT ANTENNA WITH LOSSY CONDUCTIVE MATERIAL FOR LOW VSWR

[75] Inventor: Louis L. Nagy, Warren, Mich.

[73] Assignee: General Motors Corporation, Detroit, Mich.

[21] Appl. No.: 889,182

[22] Filed: Jul. 25, 1986

[51] Int. Cl.[4] ..... H01Q 1/32

[52] U.S. Cl. ..... 343/712; 343/713

[58] Field of Search ..... 343/712, 713

[56] References Cited

U.S. PATENT DOCUMENTS 3,007,164 10/1961 Davis ..... 343/712

4,229,744 10/1980 Leudtke et al. ..... 343/713

FOREIGN PATENT DOCUMENTS 55-46617 4/1980 Japan ..... 343/712

*Primary Examiner*—William L. Sikes

*Assistant Examiner*—Hoanganh Le

*Attorney, Agent, or Firm*—Robert M. Sigler

[57] ABSTRACT

Slot antenna apparatus for a motor vehicle roof made of an electrically conducting material with a central non-conducting portion comprises a horizontal sheet of electrically conducting material attached to the roof, the horizontal sheet including a looped slot adjacent the central non-conducting portion which divides the sheet into inner and outer portions, the slot having a total loop length of substantially one wavelength in the commercial FM broadcasting band. The horizontal sheet material has a comparatively high sheet resistance of 1 to 2 ohms per square to produce a maximum VSWR of 5 and preferably below 3. The material may be comprise a coating of nickel in an acrylic binder on the underside of an SMC roof panel. The horizontal sheet may be grounded at DC and commercial AM frequencies by a direct conductive connection between the outer portion thereof and the conducting portion of the roof and at commercial FM frequencies by the capacitive coupling of an overlap of substantially the complete periphery of the outer portion and the conducting portion of the roof. A common AM/FM feed point may be provided at the front center of the slot, or separate AM and FM feed points may be provided at the side center and front center, respectively, of the slot.

3 Claims, 10 Drawing Figures

VEHICLE ROOF MOUNTED SLOT ANTENNA WITH LOSSY CONDUCTIVE MATERIAL FOR LOW VSWR

BACKGROUND OF THE INVENTION

This invention relates to a slot antenna for a motor vehicle and particularly for a non-cavity-backed slot antenna in the roof of the vehicle suitable for commercial AM and FM radio reception. Such an antenna is linked with the vehicle body itself, and its characteristics are profoundly influenced by those of the vehicle body.

In the prior art, most vehicle mounted slot antennas have been disclosed in the vehicle trunk lid or as cavity backed antennas in the vehicle roof for directional signal locating purposes. The roof mounting for a slot antenna is superior to a trunk mounting because of the additional height of the antenna, which improves gain in both the AM and FM bands and which also removes it from the signal "shadow" of the upper portions of the vehicle body for an improved FM reception pattern. The lack of a cavity back for the antenna greatly reduces the capacitive loading of the antenna to enable reception at commercial AM frequencies, besides eliminating the bulk of the cavity from the vehicle roof.

There are several aspects of such a vehicle roof mounted slot antenna, however, which are critical to its performance but have not been shown in the prior art. A slot antenna of this type must be fed and grounded properly. There are several grounds to consider: DC ground, signal ground at AM frequencies and signal ground at FM frequencies. In addition, the optimum feed points may be different for signals in the commercial AM and FM broadcast bands. Finally, the material of the conducting members bordering the slots is also important in reducing the voltage standing wave ratio (VSWR) of the antenna.

SUMMARY OF THE INVENTION

The invention is a slot antenna apparatus for a motor vehicle. The vehicle forms part of the antenna and comprises a vehicle body comprising an electrically conducting material and having a lower body portion, a plurality of vertical pillars defining window openings and a horizontal roof portion with a central portion made of electrically non-conducting material. A horizontal sheet of electrically conducting material is attached to the roof portion, the horizontal sheet including a looped slot adjacent the central portion of the roof portion which divides the sheet into inner and outer portions and has a total loop length of substantially one wavelength in the commercial FM broadcasting band. The sheet comprises a material having a sheet resistance of 1 to 2 ohms per square to produce a maximum VSWR of 5. Antenna feed means are connected to the inner portion of the horizontal sheet at its front center relative to the vehicle body; and means are provided to ground the antenna to the vehicle body at DC and at radio frequencies in the commercial AM and FM bands.

The antenna may be in the form of electrically conducting coating applied to the underside of a plastic resin or similar non-conducting roof panel which itself has some overlap over/under the metal portion of the vehicle roof. A single AM/FM feed may be provided at the front center of the slot or a separate AM feed may be provided at the side center of the slot, 90 degrees rotated from the front center thereof, with only an FM feed at the front center. The antenna produced is thus effective to act in both the AM and FM commercial frequency bands. Further details and advantages will be apparent from the accompanying drawings and following description of a preferred embodiment.

DESCRIPTION OF A PREFERRED EMBODIMENT

Figure 1:
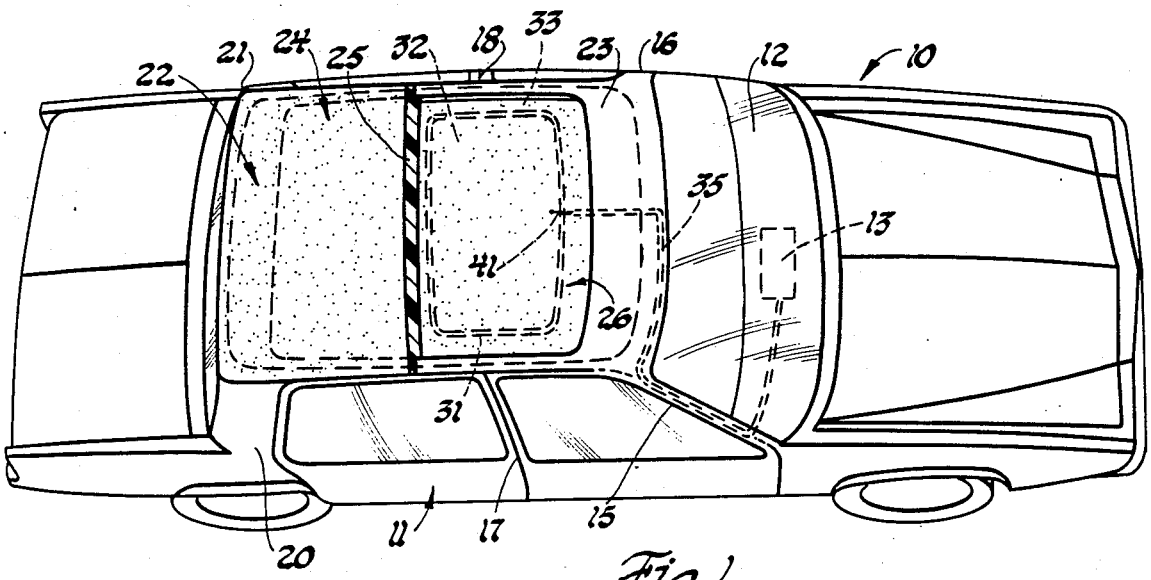
FIG. 1 shows a perspective drawing of a motor vehicle having a roof mounted slot antenna with a common AM and FM feed point.
Figure 2A:
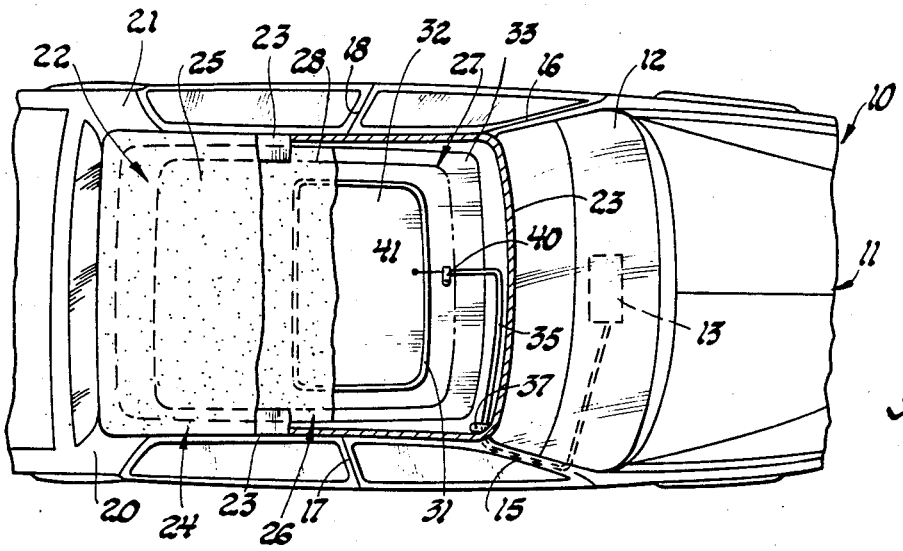
FIGS. 2*a* and 2*b* show top views of a portion of the vehicle of FIG. 1 with the roof portion partially cut away to show two embodiments of the antenna in greater detail.
Figure 2B:
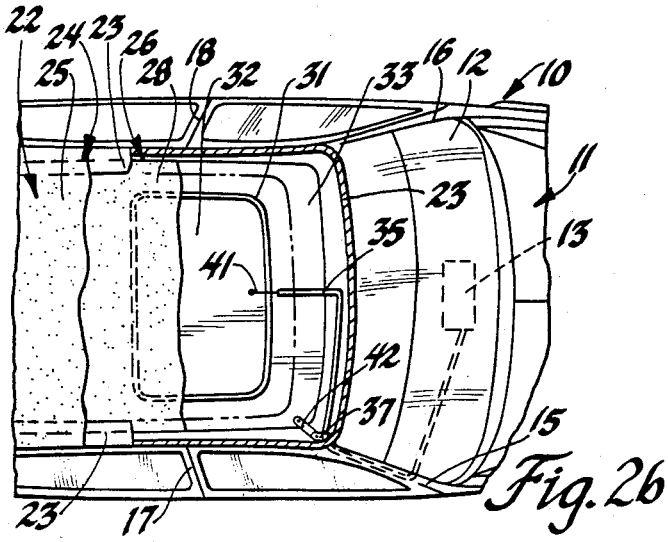
Figure 3:
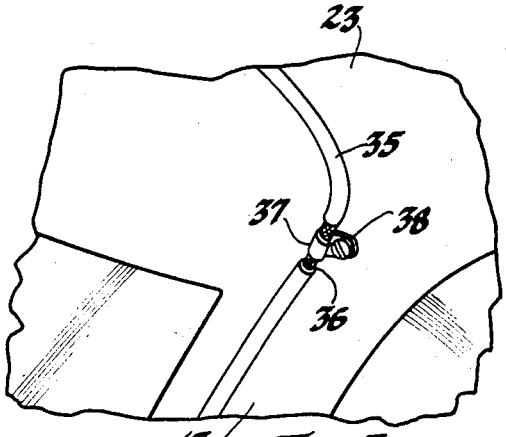
FIG. 3 shows in detail one manner of making one of the ground connections in the antenna of FIG. 1.

Referring to FIG. 1, a motor vehicle 10 has a lower body portion 11 including a dashboard 12 behind or within which is a standard AM-FM radio receiver 13. A plurality of roof pillars 15, 16, 17, 18, 20, 21 rise in a substantially vertical direction from lower body portion 11 to support a vehicle roof 22.

Vehicle roof 22 has an outer electrically conducting portion 23 typically made of steel rails connected to and supported by roof pillars 15–21. A non-conducting roof panel 24 made of a sheet molded compound (SMC) plastic resin overlaps portion 23 and comes part of the way down the vertical pillars, if necessary, to provide a smooth roof surface with no visible discontinuities. The center portion of panel 24, as defined by the inner boundary of conducting portion 23, comprises an inner, non-conducting portion 25 of roof 22. Since panel 24 covers the entire roof of the vehicle and is painted to match the remainder of the vehicle or covered with a vinyl top, there is no trace of the antenna in the external appearance of the vehicle and no wind resistance therefrom.

Figure 5:
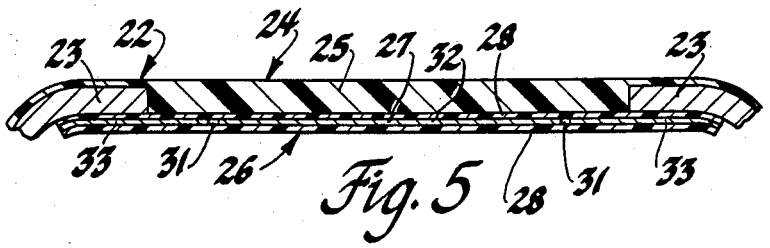

The antenna lies just below the vehicle roof as shown in FIG. 5. In this embodiment it comprises a flexible sheet 26 of electrically conducting aluminum foil sandwiched between layers of insulating plastic resin. The thickness of the sheet is exaggerated in FIG. 5 and the layers are not shown in true proportional thickness; but the Figure does show the overlap of sheet 26 including its conducting layer under the metal portion 23 of the roof. The overlap extends entirely around the roof as seen in FIG. 1, although only the sides are shown in FIG. 5.

Figure 4:
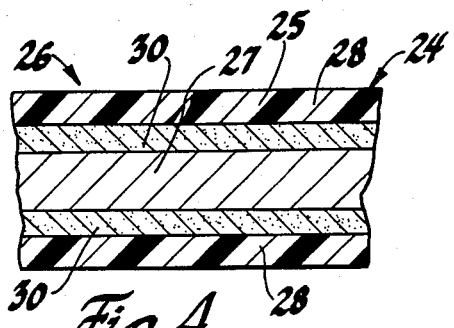
FIGS. 4 and 5 show vertical section views through a portion of the antenna of FIG. 1, with FIG. 4 being an enlarged view of a portion of FIG. 5.

A clearer and more accurate representation of the cross-section of sheet 26 than is possible in FIG. 5 is shown in FIG. 4. The electrically conducting layer 27 is shown at the center of the sandwich, with insulating layers 28 attached thereto by adhesive layers 30. Electrically conducting layer 27 may be aluminum foil, although a material with a higher sheet resistance may be used to reduce the voltage standing wave ratio (VSWR) as described later with respect to the embodiment of FIGS. 7, 8.

The conducting layer 27 of sheet 26 is not continuous. There is a rectangularly looped slot 31 having a width of about one quarter inch (6.4 mm) and a circumference of about one wavelength in the commercial FM band (approximately 128 inches or 3.25 meters) which divides layer 27 into inner 32 and outer 33 portions. The actual dimensions of the slot are 39 inches (0.99 meter) across the roof and 25 inches (0.64 meter) from front to back; and the corners are rounded. Inner portion 32 and slot 31 lie entirely beneath the non-conducting portion 25 of roof 22. Outer portion 33 lies partially beneath the non-conducting portion 25 and partially beneath the conducting portion 23 of roof 22. Outer portion 33 is preferably clamped tightly against conducting portion 23 of roof 22 to bring the conducting surfaces as close together as possible and thus maximize the capacitive coupling therebetween. This clamping should be effectively continuous around the circumference of the antenna.

The feed and ground connections of the antenna for a common AM-FM feed are shown in FIGS. *2a*, *2b* and 3. A coaxial cable 35 extends from radio receiver 13 across the dash area under or behind dashboard 12 to the bottom of the right front pillar 15. It is routed up pillar 15 to the right front corner of the roof (metal roof at this location), where a portion of the outer insulation is stripped and the braided outer or ground conductor 36 is clamped to the roof for electrical conduction therebetween by clamp 37 and screw 38. This location for the ground connection is determined from the vehicle body standing wave pattern to be a voltage null. Cable 35 further extends across the front of the roof to the center front thereof and extends from there back to the center front of slot 31. Cable 35 is anchored on outer portion 33 adjacent slot 31 by a clamp 40; and inner conductor 41 of cable 35 extends across slot 31 to be attached to inner portion 32.

In the embodiment of FIG. *2a*, the insulation is stripped from the end of cable 35 adjacent slot 31; and clamp 40 establishes electrical communication between the braided outer conductor 36 and outer portion 33 of layer 27. In the embodiment of FIG. *2b*, on the other hand, a grounding strap 42 connects the right front corner of outer portion 33 to clamp 37. Either way, a DC ground and a signal ground at commercial AM frequencies is established to the vehicle body.

As already mentioned, outer portion 33 of layer 27 lies partially beneath the non-conducting portion 25 and partially beneath the conducting portion 23 of roof 22. This overlap extends entirely around the circumference of the roof and provides capacitive coupling between the outer or ground portion 33 of layer 27 of the antenna and the electrically conducting portion of the vehicle body, which coupling establishes an FM signal ground for the antenna.

Figure 6:
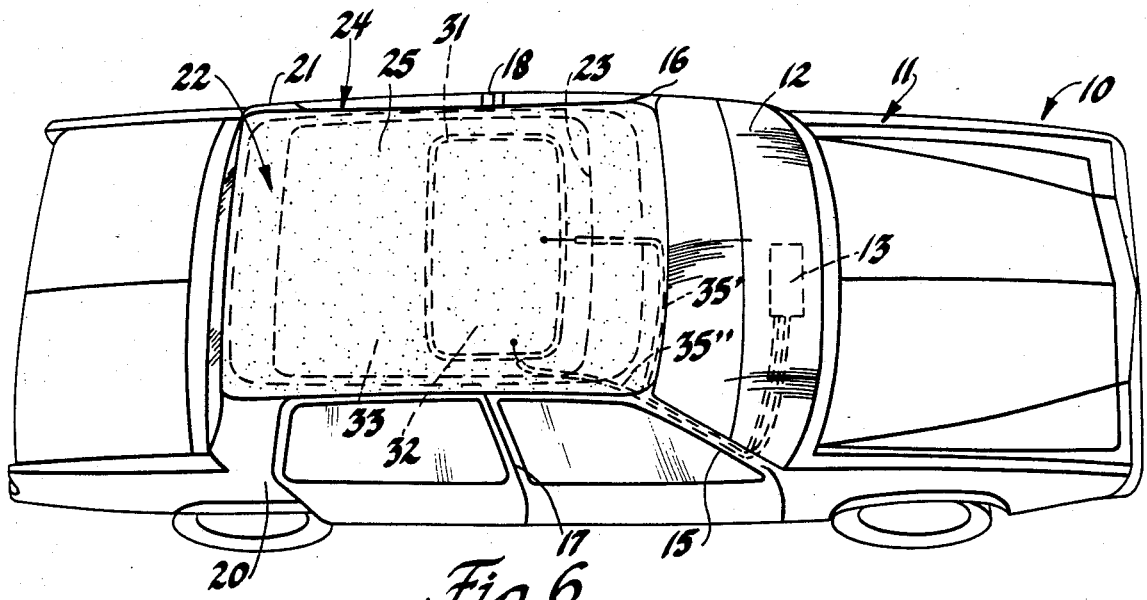
FIG. 6 shows a perspective view of a vehicle with an alternate embodiment of a vehicle roof mounted slot antenna having separate AM and FM feed points.
Figure 9:
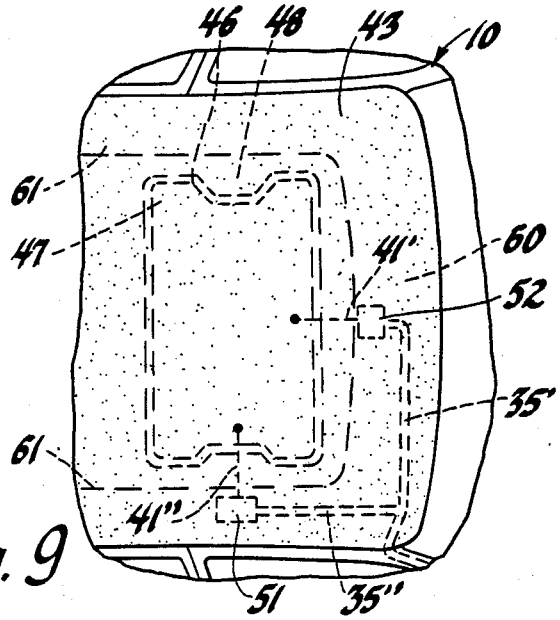
FIG. 9 shows a portion of FIG. 6 with a slightly modified alternate embodiment of an antenna having separate AM and FM feed points.

An alternate embodiment of the antenna is shown in FIG. 6, wherein separate feed points are provided for AM and FM reception. It has been determined, at least for some vehicle structures, that optimum FM reception with a slot as described above is obtained with a center front feed while optimum AM reception is obtained with a side feed. Therefore, in this embodiment, dual cables 35' and 35'' are provided. Cable 35' is connected at its lower end to the FM tuner of receiver 13 and is routed and connected as is cable 35 of the previous embodiments. Cable 35'' is connected at its lower end to the AM tuner of receiver 13 and follows cable 35' to the top of pillar 15; but it extends from there back along the side of the roof and then inward therefrom as shown to feed slot 31 at the right side thereof. The antenna thereby becomes a front fed slot antenna for FM reception and a side fed slot antenna for AM reception. This principle may be extended to other frequency bands as further testing determines the optimum feed points for CB or cellular telephone frequencies. The principle could also be used in an embodiment wherein separate AM and FM portions, 51 and 52, respectively, of the receiver are physically located at feeds 41' and 41'', respectively, of the slot antenna, as shown in FIG. 9, with the remainder of the receiver in dashboard 12. This configuration has the potential to eliminate the RF signal loss associated with the coaxial cable, permit antenna matching at each slot terminal, remove part of the radio from the dash area and reduce electromagnetic compatibility problems, depending on how much of the radio is removed to the roof area. If only the RF portions of the radio are included in devices 51 and 52, coaxial cables would be run down to receiver 13 in the manner already shown or could be joined at some point with a splitter. If the IF and detector sections are also included, plain audio cable may be used. In either case, a tuner control cable may be required from receiver 13 to devices 51 and 52 to control tuning therein.

Figure 7:
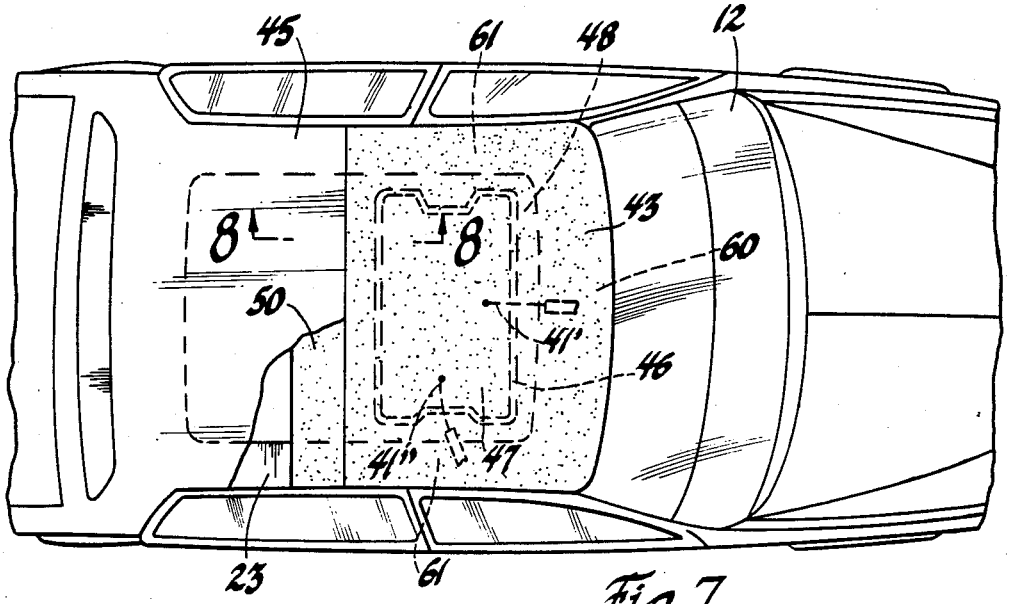
FIG. 7 shows a partial cutaway top view of an alternative embodiment of a roof mounted slot antenna.
Figure 8:
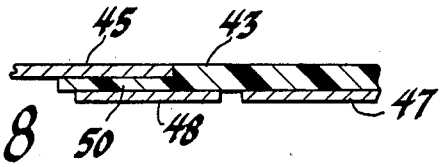
FIG. 8 is a partial section view along lines 8—8 in FIG. 7.

Another embodiment of the invention is shown in FIGS. 7 and 8. In this embodiment, the antenna is applied as a coating on the underside of the plastic non-conducting portion of the vehicle roof. As seen in FIG. 7, a sheet molded compound (SMC) panel 43 overlaps the top of front and side rails 60 and 61 of the outer conducting portion 23 of the roof at the front and sides thereof but extends under a sheet metal rear portion 45 of the roof. The antenna is a slot 46 between inner 47 and outer 48 painted-on areas of a layer of a conductive nickel coating having a sheet electrical conductivity of 1–2 ohms per square (that is, per square of any size: inch, meter, etc.) in order to reduce the antenna's VSWR to an acceptable level of 5 or less (preferably 3 or less). The use of such a resistive material is a change from the conventional teaching of the prior art, in which a much higher conductivity (a material such as silver, copper, aluminum or silver paint with sheet resistance much less than 0.1 ohm) is considered optimum. However, in the context of this vehicle roof mounted, non cavity backed slot antenna, the distributed resistance of the higher resistive material effectively increases the load resistance at the antenna terminals and appears to improve the electromagnetic radiation efficiency by increasing the surface impedance, which is proportional to the square root of the frequency divided by the conductivity, and the skin depth, which is inversely proportional to the square root of the frequency times the conductivity; and this increased radiation efficiency appears to more than make up for any resistive losses in the antenna. A specific example of the paint is Electrodag (R) 440, available from Acheson Colloids Co., Port Huron, MI. The slot dimensions are approximately 0.006 meters wide in a rectangle 1.035 meters across the car by 0.65 meters front to back. In the embodiment of FIG. 7, a single lead 41' for AM and FM reception may be provided; or separate leads 41' for FM reception and 41'' for AM reception may be used, as previously described for other embodiments.

FIG. 8 shows a partial cross section of the rear conducting to non-conducting roof interface. The SMC panel 43 and the metal portion 45 abut to form a generally smooth outer surface which supports a vinyl or other roof covering which covers the entire roof or that portion necessary to hide the apparatus. A portion 50 of SMC panel 43 underlies metal portion 45 to provide structural support at the joint and extend outer area 48 of the conductive coating under portion 50 of the roof. Capacitive coupling may be improved by clamping with bolts or rivets to hold portions 50 and 45 tightly together. If so, the spacing of the bolts or rivets should be sufficiently close as to provide essentially continuous clamping, such as every one-tenth of a wavelength of the received frequencies. This would be, for example, about every 9 inches or so. This could also be done around the remainder of the antenna to clamp portion 50 with coated area 48 against the metal roof rails comprising portion 23 of the roof.

In the preceding specification and the claims which follow, radio frequencies in the commercial AM broadcasting band are frequencies assigned by the FCC to commercial broadcasting at the time of the filing of this application: specifically 535 Kilahertz to 1605 Kilohertz, inclusive. Furthermore, radio frequencies in the commercial FM band are frequencies assigned by the FCC to commercial FM broadcasting at the time of the filing of this application: specifically 88.1 Megahertz to 107.9 Megahertz inclusive. Wavelengths in the same commercial broadcasting bands refer to wavelengths corresponding to the same frequencies: specifically 2.78 meters to 3.41 meters inclusive for FM.

The embodiments of the invention in which an exclusive property or privilege is claimed are defined as follows:

1. Slot antenna apparatus for a motor vehicle comprising, in combination:

a vehicle body comprising an electrically conducting material and having a lower body portion, a plurality of vertical pillars defining window openings and a horizontal roof portion with a central portion made of electrically non-conducting material;

a horizontal sheet of electrically conducting material attached to the roof portion, the horizontal sheet including a looped slot adjacent the central portion of the roof portion dividing the sheet into inner and outer portions, the slot having a total loop length of substantially one wavelength in the commercial FM broadcasting band, the sheet further comprising a material having a sheet conductivity of 1 to 2 ohms per square to produce a maximum VSWR of 5;

antenna feed means connected to the inner portion of the horizontal sheet at its front center relative to the vehicle body; and means effective to ground the antenna to the vehicle body at DC and at radio frequencies in the commercial AM and FM bands.

2. The slot antenna apparatus of claim 1 wherein the material of the horizontal sheet comprises a coating of nickel in an acrylic binder on the surface of the central portion of the horizontal roof portion of the vehicle body.

3. The slot antenna apparatus of claim 1 wherein the antenna feed means connected to the inner portion of the horizontal sheet at its front center relative to the vehicle body is effective to connect to FM radio receiver apparatus, the slot antenna apparatus further comprising antenna feed means connected to the inner portion of the horizontal sheet at its side center essentially 90 degrees rotated from the front center relative to the vehicle body and effective to connect to AM radio receiver apparatus.

* * * * *